United States Patent [19]

Jo

[11] 4,053,392

[45] Oct. 11, 1977

[54] FRACTIONATION PROCESS

[75] Inventor: Hong-Kyu Jo, Des Plaines, Ill.

[73] Assignee: UOP Inc., Des Plaines, Ill.

[21] Appl. No.: 713,940

[22] Filed: Aug. 12, 1976

[51] Int. Cl.[2] ..... C10G 7/00

[52] U.S. Cl. ..... 208/354; 208/355

[58] Field of Search ..... 208/354, 355, 358

[56] References Cited

U.S. PATENT DOCUMENTS

| | | | |
|---|---|---|---|
| 2,029,528 | 2/1936 | Gard | 208/355 |
| 2,348,681 | 5/1944 | Houghland | 208/353 |
| 2,657,243 | 10/1953 | Giraitis et al. | 208/355 |
| 3,320,158 | 5/1967 | Potts | 208/354 |

*Primary Examiner*—Herbert Levine

*Attorney, Agent, or Firm*—James R. Hoatson, Jr.; Robert W. Erickson; William H. Page, II

[57] ABSTRACT

A process for fractionating hydrocarbons wherein the overhead vapors of two fractionation columns are admixed and then condensed in a single overhead condenser. The overhead liquid is divided into two portions, one of which is used to supply reflux to the column receiving the process feed stream and the other as feed to the second column. Also disclosed is a control system for use on the process.

3 Claims, 1 Drawing Figure

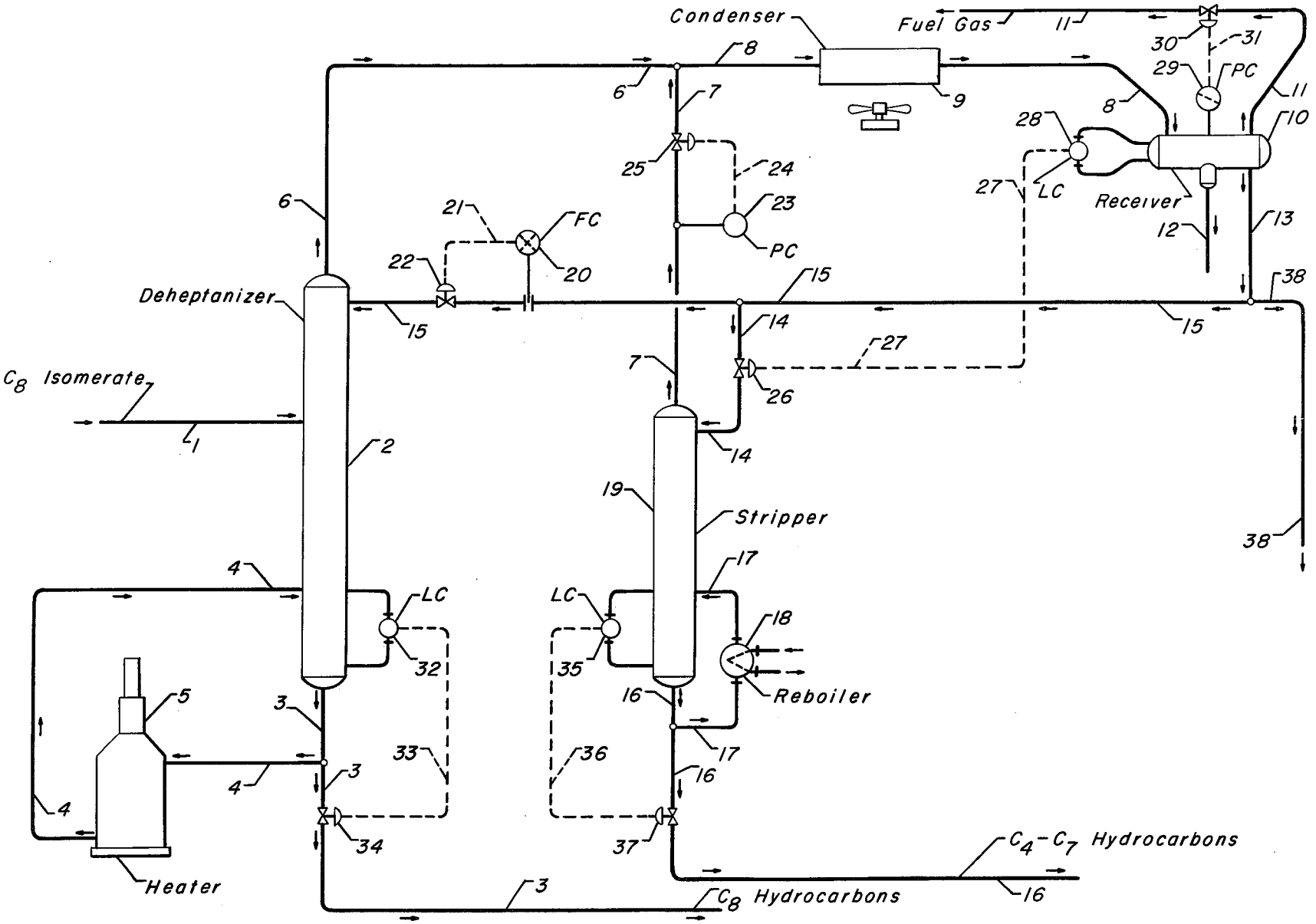
Fuel Gas
Condenser
Receiver
PC
LC
FC
Stripper
Reboiler
Deheptanizer
$C_8$ Isomerate
$C_4$-$C_7$ Hydrocarbons
$C_8$ Hydrocarbons
Heater

FRACTIONATION PROCESS

FIELD OF THE INVENTION

The invention relates to a process for fractionating mineral oils such as found in Class 208. The invention also relates to a separatory distillation process such as found in Class 203. The invention also relates to process control system for use on a fractionation zone comprising two fractionation columns utilizing a single overhead condenser and receiver.

PRIOR ART

Fractionation is one of the oldest and most developed areas of petroleum and petrochemical processing. Accordingly, the knowledge needed to design, manufacture and operate fractionation columns and their accouterments is possessed by those skilled in the art and is available from a great many references. As part of the operation of fractionation columns a stream of vapor rising from the topmost fractionation tray is removed as the overhead vapor stream of the column. This overhead vapor stream is then passed through a cooling or condensing means which effects at least a partial condensation of the overhead vapor stream to form a liquid commonly referred to as the overhead liquid. The condensation may cause the formation of both hydrocarbon and aqueous liquid phases which are collected and allowed to separate in an overhead receiver. The aqueous phase is then normally decanted from the overhead receiver. A portion of the overhead liquid is customarily withdrawn and returned to the top of the fractionation column as reflux to aid in the fractionation operation. A second stream of the overhead liquid is often removed as an overhead product. Heretofore, the overhead vapor stream of each fractionation column has been passed into a separate condensing means, and the resulting liquid material has been collected in the separate overhead receiver. It is known to those skilled in the art that the overhead product of a fractionation column may contain two or more separate components and be further fractionated to effect a separation or purification of the overhead liquid.

Examples of prior art control systems and fractionation methods are provided in U.S. Pat. Nos. 2,357,113 (Cl. 196–132), 2,976,234 (Cl. 208–350), 3,803,002 (Cl. 203–1), 3,855,074 (Cl. 203–2) and 3,905,874 (Cl. 203–1).

DESCRIPTION OF THE DRAWING

The drawing illustrates the preferred embodiment of the invention. For the purposes of simplicity and clarity numerous items required for successful operation but not forming a part of the invention concept have been deleted. Required apparatus such as pumps, valves and other subsystems are therefore not shown. This description and this drawing are not intended to place undue limitations on the scope of the invention as shown or as described in the other embodiments herein.

For purposes of description it is assumed that the feed stream entering the process through line 1 comprises a $C_8$ isomerate produced by the condensation of the effluent of a catalytic reaction zone designed to produce an equilibrium mixture of xylene isomers. The feed stream contains residual amounts of hydrogen and a full range of $C_1$–$C_8$ hydrocarbons. It is passed into an intermediate point of a first fractionation column 2 which operated at conditions which effect separation of the feed stream into a first overhead vapor stream removed in line 6 and a first bottoms product stream removed in line 3. The first overhead vapor stream comprises the hydrogen and $C_1$–$C_6$ hydrocarbons contained in the feed stream and also a small amount of $C_7$ hydrocarbons. The first bottoms stream contains most of the $C_7$ and essentially all of the $C_8$ hydrocarbons contained in the feed stream. A portion of the first bottoms stream is diverted through line 4 and passed through a heater 5 to supply heat to the fractionation column. The remaining portion of the first bottoms stream is withdrawn through line 3 at a rate controlled by a valve means 34 in response to a signal carried from a level controller 32 by means 33.

The first overhead vapor stream is combined with a second overhead vapor stream passing through line 7, and the resulting admixture travels through line 8 into a condensing means 9. The resulting mixed-phase condensing means effluent is passed into an overhead receiver 10. An off-gas stream comprising hydrogen and $C_1$–$C_3$ hydrocarbons is removed from the overhead receiver in line 11. The rate of removal of this gas stream regulates the pressure of the overhead system and the first column. This rate is controlled by a flow valve 30 governed through means 31 by a pressure controller 29. Any water which collects in the overhead receiver is removed through line 12. The hydrocarbonaceous overhead liquid collected in the overhead receiver is withdrawn through line 13 and pressurized by a pump not shown. It is then divided into two portions of equal composition which pass into lines 15 and 14. The material in line 15 enters the top of the first fractionation column as reflux at a rate controlled by a flow valve means 22 in response to a signal carried from a flow measurement and control means 20 by means 21.

The material in line 14 enters an upper portion of a second fractionation column 19 as the feed stream to this column. The rate of flow of this stream is set by a level control means 28 which generates a signal carried to flow valve means 26 by means 27. This second column is operated at conditions selected to effect a separation of this entering liquid into a second bottoms stream comprising $C_4$–$C_6$ hydrocarbons removed in line 16 and the second overhead vapor comprising $H_2$ and $C_1$–$C_4$ hydrocarbons. These conditions may include a higher pressure than utilized in the first column. The pressure within the second column is set by a second pressure controller 23, which activates control valve 25 through means 24. The second overhead stream is removed in line 7. It differs from the first overhead vapor stream in that it preferably does not contain any substantial amount of the materials removed through line 11 or through line 16. It will however contain at least an equilibrium amount of the materials rejected in line 11. Heat is supplied to the second fractionation column by diverting a portion of the second bottoms stream through a reboiler 18 via line 17. The net rate of removal of the second bottoms stream is controlled by flow valve means 37, which is activated in response to a signal carried by means 36 from a level controller 35. If it is desired a stream of the overhead liquid can be removed from the process as through line 38.

DETAILED DESCRIPTION

In the petroleum and petrochemical industries it is often desired or necessary to separate lighter hydrocarbons from heavier hydrocarbons, with the only practical method of accomplishing this being fractionation. A common situation is the fractionation of reaction zone effluents to remove light hydrocarbons and residual gases formed in the reaction zone in order to prepare the reaction zone effluent for passage into a downstream product recovery operation. For instance, the effluent of an isomerization zone designed to produce an equilibrium mixture of xylene isomers may produce an effluent stream which contains hydrogen and various $C_1$-$C_7$ hydrocarbons which it is not desired to pass into the molecular sieve separatory processes which are used for the recovery of particular xylene isomers. A somewhat similar situation exists in many other operations such as alkylation, transalkylation, pentane and butane isomerization, reforming, etc. The fractionation column to which these effluent streams is charged therefore produces an overhead product containing a wide variety of hydrocarbons having boiling points below the desired products. Some of these hydrocarbons such as methane and ethane, and the relatively impure hydrogen which is sometimes present, are normally vented to fuel gas systems since this is the highest economic use for these light materials. However, the heavier hydrocarbons such as propane, butanes, pentanes or $C_6$ and $C_7$ hydrocarbons including benzene and toluene are very valuable as products or raw materials. It is therefore desirable to recover these materials contained in the overhead product of the first fractionation column. For this reason the overhead product of the first fractionation column is itself often subjected to a fractionation operation designed to recover these valuable hydrocarbons while rejecting the lighter materials overhead.

It is often desirable to operate the column which receives the broad boiling range feed stream at an elevated pressure. For instance, this is being done increasingly at the present time to raise the temperature of the column's overhead vapors. This allows increased utilization of the overhead vapors as a heating medium for some other fractionation column or another process stream and has economic advantages when the utilities cost of operating the process are considered. Another situation in which elevated pressures are used arises when it is desired to discharge the off-gas stream of the overhead receiver into a pressurized fuel gas system. To avoid the necessity of having a compressor on the off-gas line from the overhead receiver, the entire separatory process including the fractionation column is operated at a pressure which exceeds that of the fuel gas system. The higher pressure thereby imposed on the overhead receiver makes the compressor unnecessary and allows operation utilizing only the control valve which is normally present in the vent gas line to control the separatory process pressure.

The overhead condenser of a fractionation column represents a sizable percentage of the total capital cost of constructing the column and its associated equipment. For instance, for typical moderate pressure fractionators having about 50 trays it has been estimated that the overhead condenser represents approximately 15% of the entire capital cost. In comparison the fractionation trays represent only about 2.6%, instruments 4.6% and piping about 12% of the cost of the column. The overhead condenser has in fact been found to be the largest single cost item on the column when the cost of design and engineering is included in estimating the cost of the column. In systems employing two fractionation columns, capital costs may therefore be reduced by the use of a process which requires only one overhead condenser. This is due to the reduced design and equipment costs of one large condenser compared to two of smaller size.

It is an objective of the present invention to provide a process for the fractionation of hydrocarbons. It is another objective of the present invention to provide a process for the fractionation of hydrocarbons which is capable of purifying a feed stream in a first fractionation column and of recovering valuable components from the overhead material of the first fractionation column through the use of a second fractionation column without the necessity of constructing two overhead condensers. It is a further objective to provide a fractionation process in which overhead vapors may be discharged into a pressurized off-gas system without the use of a compressor and without the loss of valuable higher boiling point materials.

The process is one of general application. As such it is not restricted to any particular feed stream composition or mechanical arrangement within the fractionation columns. The feed stream may therefore be a mixture of a relatively few pure hydrocarbons or a broad boiling range petroleum fraction containing many hydrocarbonaceous compounds, such as a naphtha or kerosene. For instance, the feed stream may be limited to just methane, propane and butanes. Another example is the removal of hydrogen, oxygen or water from a charge stock being removed from storage and which it is desired to separate into two fractions. The feed stream may contain other inorganic compounds such as carbon tetrachloride, boron trifluoride, ammonia, sulfur dioxide, hydrogen sulfide or various mercaptans. The feed stream is, however, subject to the restraint that it must contain at least three separate components having different boiling points. It must contain one component selected for removal as each of the two bottoms liquid streams and one component suitable to be removed as a vapor or liquid from the overhead receiver.

It is within the expertise of those skilled in the art to select and design appropriate equipment for preforming the process and also to set proper operating conditions for the separation of hydrocarbons. A general range of operating conditions for both fractionation columns includes a pressure of from 0.5 atmospheres absolute to about 71 atmospheres absolute and a temperature of from about 150° F. to 700° F. or higher. These operating ranges are intended to refer to the conditions which exist at the bottom of each column. A preferred range of operating conditions for the columns is a bottoms temperature of from about 300° F. to about 550° F. and a pressure of about 1.5 to 30 atmospheres absolute. It is to be recognized that the conditions will differ between the two columns. The pressure at the top of each column may be substantially the same since they are interconnected by the overhead vapor piping system, but a higher pressure may be utilized in the second column in the manner shown in the drawing. At equal pressures, the temperatures maintained within the second or stripping column will be lower than those in the first column. The reflux ratio for the two columns is also subject to variation. Preferably, it is maintained in the range of from 0.5:1 to 5:1 for either column.

The feed stream to the process is fed to the first column at an intermediate point. By this it is intended to indicate that the feed stream enters the column at a vertical point which is separated from both the top and the bottom of the column by at least two fractionation trays. If a packed column is used, an amount of packing equal to at least one theoretical transfer unit is located between the feed point and each extremity. The overhead liquid is fed to an upper portion of the stripping or second fractionation column. The term upper portion as used in this context is intended to refer to the upper one-half of the column. Preferably, this stream enters the column at an elevation which is separated from the top of the column by less than three fractionation trays. The feed stream will in most instances be fed directly onto the top tray, but the lower feed points may be desired to aid in the fractionation. If they are used, reflux should be fed to the top of the second column.

The subject process may also be characterized by two inherent differences in the compositions of various process streams. First, the bottoms liquid product stream removed from the second column will be substantially free of the main components of the bottoms product stream of the first column. Second, the overhead vapor stream of the second column is preferably substantially free of the lightest component of the feed stream removed as the off-gas stream and also of the heavier components removed in the bottoms product stream of the second column. Although both bottoms streams will be relatively pure and preferably at least 99% free of any undesired components, the overhead streams may contain varying amounts of all of the components of the feed stream except those removed as the first bottoms stream. Therefore in reference to the overhead vapor streams, the term substantially free of a designated compound is intended to indicate the presence of not more than 5 mole percent of the designated compound. Preferably, these compounds comprise less than 2 mole percent of the overhead stream.

The subject process may be performed using a system such as that shown in the drawing or one which departs from it. For instance, the condensing means may utilize cooling water or refrigeration instead of air as is illustrated. Variations are also possible in the control system shown. The rate of reflux to the first column may be controlled in response to one or more vapor or liquid temperatures monitored within the first column instead of being set at a constant but variable rate. The pressure control system for use on the second column may be deleted. However, the system illustrated is preferred. This system includes the process transfer lines 6, 8, 7, 13, 14 and 15, the valve means 22, 25, 26, 30, 34 and 37, and the control elements 20, 23, 28, 32 and 35.

In accordance with this description the preferred embodiment may be characterized as a process for fractionating hydrocarbons which comprises the steps of passing a feed stream comprising $C_2$–$C_8$ hydrocarbons into an intermediate point of a first fractionation column operated at conditions effective to cause the separation of the feed stream into a first overhead vapor comprising $C_2$–$C_6$ hydrocarbons and a first bottoms stream comprising $C_7$ and $C_8$ hydrocarbons, including a superatmospheric pressure and the passage of a reflux stream into the top of the first fractionation column; admixing the first overhead vapor stream with a second overhead vapor stream and passing the resultant admixture through a condensing means, and passing a resultant mixed-phase condensing means effluent stream into an overhead receiver; removing an off-gas stream comprising $C_1$ and $C_2$ hydrocarbons from the overhead receiver; removing an overhead liquid comprising $C_3$–$C_6$ hydrocarbons from the overhead receiver, and dividing the overhead liquid into two portions of equal composition; passing a first portion of the overhead liquid into the first fractionation column as the reflux stream; and, passing a second portion of the overhead liquid into an upper portion of a second fractionation column operated at conditions effective to cause the separation of the second portion of the overhead liquid into the second overhead vapor stream, which comprises $C_3$ hydrocarbons and is substantially free of $C_5$ hydrocarbons, and a second bottoms stream comprising $C_5$ and $C_6$ hydrocarbons.

The invention is further illustrated by this example. A feed stream comprising hydrogen, xylenes, ethylbenzene and various $C_1$–$C_7$ hydrocarbons is passed into a 40-tray fractionation column at the twenty-first tray. It has a temperature of about 250° F., a pressure of about 78 psig. and a flow rate of approximately 1851 mph (moles per hour). An overhead vapor stream having an average molecular weight of about 75 and a flow rate of about 869 mph leaves this column at a temperature of about 273° F. at 60 psig. This overhead stream includes about 14 mph of hydrogen, 25.6 mph of methane, 7 mph of ethane and 12 mph of propane which were contained in the feed stream. Additional amounts of these materials are dissolved in the reflux liquid and also enter the overhead vapor stream. A bottoms liquid product is removed from the column at a temperature of about 417° F. at a flow rate of about 1722 mph. This bottoms product contains about 29 mph of toluene, 186 mph of ethylbenzene and 1377 mph of mixed xylenes. The lightest material in this stream is a trace of benzene.

This first overhead stream is admixed with a 22 mph stripper overhead vapor stream, and the combined vapors are then cooled to about 110° F. and fed into an overhead receiver at a pressure of 56 psig. A 95.2 mph vent gas stream is removed from the overhead receiver and discharged into a fuel gas system. This stream comprises essentially all of the hydrogen, methane, ethane, and $C_3$ hydrocarbons contained in the feed stream. It also contains about 30.2 mph of butane, 3.2 mph of pentanes and smaller amounts of various higher boiling hydrocarbons. An overhead liquid stream is withdrawn from the receiver at the rate of about 795 mph and is split into two portions. The larger portion is fed to the top tray of the fractionation column as reflux at a rate of 740 mph.

A smaller portion of overhead liquid is fed onto the top tray of a 20-tray stripper column at a temperature of 110° F. The stripper is operated with a bottoms liquid temperature of about 284° F. at 90 psig. This is effective to separate the smaller portion of the overhead liquid stream into the previously mentioned overhead vapor stream and a second bottoms liquid stream. The stripper overhead vapor has a temperature of 129° F. and an average molecular weight of approximately 55.1. It contains about 0.5 mph of ethane, 2.5 mph of propane, 18.4 mph of butanes and about 0.2 mph of pentanes. The second bottoms liquid stream has a flow rate of about 33 mph and contains no $C_1$–$C_3$ hydrocarbons and only about 0.3 mph of butanes. It does contain about 5.5 mph of pentanes and varying amounts of benzene, toluene, $C_8$ paraffins and naphthalenes and other hydrocarbons.

I claim as my invention:

1. A process for fractionating hydrocarbons which comprises the steps of:

a. passing a feed stream comprising $C_2$ – $C_8$ hydrocarbons into an intermediate point of a first fractionation column operated at conditions effective to cause the separation of said feed stream into a first overhead vapor comprising $C_2$ – $C_6$ hydrocarbons and a first bottoms stream substantially free of $C_6$ hydrocarbons comprising $C_7$ and $C_8$ hydrocarbons, including a superatmospheric pressure and the passage of a reflux stream into the top of said first fractionation column and wherein said first bottoms stream is removed as a product stream from said first fractionation column;

b. admixing said first overhead vapor stream with a second overhead vapor stream and passing the resultant admixture through a condensing means, and passing a resultant mixed-phase condensing means effluent stream into an overhead receiver;

c. removing an off-gas stream comprising $C_1$ and $C_2$ hydrocarbons from said overhead receiver;

d. removing an overhead liquid comprising $C_3 - C_6$ hydrocarbons from said overhead receiver, and dividing said overhead liquid into two portions of equal composition;

e. passing a first portion of said overhead liquid into said first fractionation column as said reflux stream; and, f. passing a second portion of said overhead liquid into an upper portion of a second fractionation column as the sole charge stream to said second fractionation column which is operated at conditions effective to cause the separation of said second portion of said overhead liquid into said second overhead vapor stream, which comprises, $C_3$ hydrocarbons and is substantially free of $C_5$ or heavier hydrocarbons, and a second bottoms stream comprising $C_5$ and $C_6$ hydrocarbons.

2. The process of claim 1 further characterized in that the superatmospheric pressure is above 50 psig. and in that said feed stream comprises $C_8$ aromatic hydrocarbons.

3. The process of claim 1 in which said second fractionation column is operated at the same pressure as said first fractionation column, and the bottom temperature of said second fractionation column is lower than the bottom temperature of said first fractionation column.

* * * * *